US009446494B2

(12) United States Patent
Becker et al.

(10) Patent No.: US 9,446,494 B2
(45) Date of Patent: Sep. 20, 2016

(54) DEVICE FOR GRINDING, PRECISION-GRINDING AND/OR POLISHING OF WORKPIECES IN OPTICAL QUALITY, PARTICULARLY OF SPHERICAL LENS SURFACES IN PRECISION OPTICS

(71) Applicant: Satisloh AG, Baar (CH)

(72) Inventors: Benjamin Becker, Rabenau (DE); Joachim Diehl, Giessen (DE); Carsten Stroh, Grossostheim (DE); Robert Zeuke, Wetzlar/Garbenheim (DE)

(73) Assignee: Satisloh AG, Baar (CH)

( * ) Notice: Subject to any disclaimer, the term of this patent is extended or adjusted under 35 U.S.C. 154(b) by 7 days.

(21) Appl. No.: 14/658,534

(22) Filed: Mar. 16, 2015

(65) Prior Publication Data

US 2015/0258652 A1 Sep. 17, 2015

(30) Foreign Application Priority Data

Mar. 17, 2014 (DE) ..... 10 2014 003 598

(51) Int. Cl.
*B24B 13/00* (2006.01)
*B24B 11/00* (2006.01)
*B24B 13/01* (2006.01)

(52) U.S. Cl.
CPC ..... *B24B 11/00* (2013.01); *B24B 13/01* (2013.01)

(58) Field of Classification Search
CPC ..... B24B 11/00; B24B 13/01; B24B 13/005; B24B 13/02; B24B 13/00; B24B 13/0012
USPC ..... 451/5, 11, 42, 58, 65, 256
See application file for complete search history.

(56) References Cited

U.S. PATENT DOCUMENTS 2,087,687 A * 7/1937 Houchin ..... B24B 13/0012 451/277
2,975,565 A * 3/1961 Phillips ..... B24B 13/043 351/159.74

(Continued)

FOREIGN PATENT DOCUMENTS

DE 198 46 260 A1 4/2000
DE 20 2008 016 620 U1 3/2009
DE 10 2009 006 797 A1 8/2009

OTHER PUBLICATIONS

DIN 58741-2, Optikfertigung—Diamantbesetzte Topfscheiben—Teil 2: Mit Anschlusszylinder, Nov. 2004, pp. 166-181.

(Continued)

*Primary Examiner* — George Nguyen
(74) *Attorney, Agent, or Firm* — Reising Ethington P.C.

(57) ABSTRACT

A device for grinding and/or polishing of, in particular, precision-optical spherical lens surfaces has a machine frame, a tool spindle for rotational drive of a tool about a tool axis of rotation and a workpiece spindle for rotational drive of a workpiece about a workpiece axis of rotation. The tool spindle and workpiece spindle are capable of axial relative adjustment in first and second directions extending perpendicularly to one another and in addition pivotable about a pivot axis in a pivot plane relative to one another. Equipment for cross-grinding adjustment is provided, which has an adjusting mechanism to position the workpiece spindle in a third direction extending perpendicularly to the first and second directions. A clamping mechanism activatable independently of the adjusting mechanism serves the purpose of fixing the workpiece spindle, once positioned, with respect to the machine frame.

19 Claims, 10 Drawing Sheets

(56) References Cited

U.S. PATENT DOCUMENTS 2,977,724 A * 4/1961 Kennedy ..... B24B 13/02 451/277
3,978,620 A * 9/1976 Feneberg ..... B24B 9/146 451/256
4,392,331 A * 7/1983 Schimitzek ..... B24B 13/02 451/159
4,494,338 A * 1/1985 Nagaura ..... B24B 13/04 451/123
4,584,799 A * 4/1986 Juvet ..... B24B 13/04 451/42
4,956,944 A * 9/1990 Ando ..... G05B 19/4166 451/159
5,024,024 A 6/1991 Watanabe
5,210,695 A * 5/1993 Wood ..... B24B 13/005 451/5
5,938,381 A * 8/1999 Diehl ..... B24B 11/00 409/131
5,951,376 A * 9/1999 Mandler ..... B24B 13/0031 451/178
6,155,911 A * 12/2000 Mandler ..... B24B 13/01 451/42
7,455,569 B2 * 11/2008 Schafer ..... B24B 13/0037 451/11
8,460,062 B2 * 6/2013 Schneider ..... B24B 13/0037 451/277
2007/0259608 A1 11/2007 Bechtold et al.
2011/0220018 A1 * 9/2011 Schafer ..... B24B 13/005 118/502
2015/0258652 A1 * 9/2015 Becker ..... B24B 13/01 451/256

OTHER PUBLICATIONS

DIN 58741-4, Optikfertigung—Diamantbesetzte Topfscheiben—Teil 4: Kombiwerkzeuge, Nov. 2004, pp. 182-195.
DIN 58741-6, Optikfertigung—Diamantbesetzte Topfscheiben—Teil 6: Mehrteilige Schleifwerkzeuge, Jun. 2007, pp. 218-227.
DIN 58741-7, Optikfertigung—Diamantbesetzte Topfscheiben—Teil 7: Kombinierbare Formschleifscheiben, May 2010, pp. 228-237.
DIN 58741-5, Optikfertigung—Diamantbesetzte Topfscheiben—Teil 5: Mit galvanischer Belegung, Jun. 2012, pp. 196-217.
German Office Action dated Feb. 20, 2015, Application No. 10 2014, 003 598.0, Applicant: Satisloh GmbH, 4 pages.

* cited by examiner

DEVICE FOR GRINDING, PRECISION-GRINDING AND/OR POLISHING OF WORKPIECES IN OPTICAL QUALITY, PARTICULARLY OF SPHERICAL LENS SURFACES IN PRECISION OPTICS

TECHNICAL FIELD

The present invention relates to a device for grinding, precision-grinding and/or polishing of workpieces in optical quality. In particular, the invention relates to a device for grinding, precision-grinding and/or polishing of spherical lens surfaces that are mass-processed in precision optics.

PRIOR ART

In the processing or precision-processing discussed here, for which as grinding tools use is made of, in particular, cup grinding wheels or combination grinding wheels (for example according to German standards DIN 58741-2, DIN 58741-4, DIN 58741-5, DIN 58741-6 or DIN 58741-7) or precision-grinding or polishing tools (for example polishing bowls), the tool and the workpiece rotate in the same or opposite direction and are at the same time pivoted relative to one another, so that the zone of engagement between the tool and the workpiece constantly changes.

For, in particular, dressing of a spherical polishing tool at a polishing machine and for grinding a spherical lens by a cup grinding wheel at a grinding machine it is essential for the tool axis of rotation of the tool spindle and the workpiece axis of rotation of the workpiece spindle to be disposed in a common plane of alignment in which the relative pivotation of tool spindle and workpiece spindle also takes place. Only when these geometric preconditions are fulfilled is the annular tool grinding surface in engagement with a complete annular section of the tool cutting surface for generation of the desired radius over the entire width of the processed surface, so that in the case of processing of spherical surfaces so-called 'cross-grinding' can be achieved. By 'cross-grinding' there is to be understood in general the appearance of surface processing in which semicircular processing or grinding grooves are produced on the processed spherical surface, which grooves all intersect at the apex of the spherical surface and extend away radially to all sides from the intersection point, so that a form of flower pattern arises (see FIG. 10: grinding pattern M) for an illustrative example. If, on the other hand, the aforesaid geometric preconditions are not fulfilled, i.e. if an alignment error is present between tool spindle and workpiece spindle, the alignment error can be ascertained or indicated by the generated processing or by grinding pattern M (cf. FIGS. 11 and 12 for illustrative examples). For example, when dressing a polishing bowl by a cup grinding wheel the polishing bowl is trued or dressed only on one side, the shape produced at the polishing bowl is no longer a sphere, but a prolate surface. However, a prolate polishing tool is unsuitable for a spherical polishing process.

There is no lack of proposals in the prior art for an adjusting device called equipment for cross-grinding adjustment for short by which the above-described alignment between tool spindle and workpiece spindle for generating a cross-grinding processing pattern is the desired objective. Solutions are frequently found in which the grinding spindle head is suspended on one side in a flexure bearing, whereas on the opposite side an adjusting mechanism is provided and in the simplest case is formed by one or more setting screws and compression springs, but can also comprise piezo setters or a servomotor with ball screw. The grinding spindle head can be pivoted about the flexure bearing by the adjusting mechanism, in which case the spindle axis migrates along a curve, thus executes a movement in two axial directions. Consequently, every spindle alignment setting fundamentally needs two corrections, namely one in one axial direction (y) for producing the axial alignment and one in the other axial direction (x) in order to again correct the axial spacing, which has changed as a consequence of the curved motion, by way of the corresponding linear movement axis (X axis). This requires, as with similarly known adjustable, eccentrically mounted tool spindles (see, for example, DE 198 46 260 A1: FIG. 2; column 12, lines 4 to 12) a certain degree of effort.

Further problems, particularly of flexure bearing solutions, result from the joint construction, which requires a resilient deformation of the grinding spindle head or the resilient coupling thereof to other machine parts. As a consequence of these measures, the overall stiffness of the machine is significantly diminished, which makes itself noticeable in a negative sense, particularly in the case of higher processing forces, through resulting inaccuracies and poorer quality of the processed surfaces (edge zone damage, topographical error, etc.).

Finally, solutions are also proposed in the prior art in which the entire machine upper part (for example as shown in DE 10 2006 028 164 A1) or at least a part thereof (see for example DE 20 2008 016 620 U1: FIGS. 1 to 5: spindle bracket 20) can be linearly displaced under CNC technology as a separate 'Y slide' by associated guides and drive for cross-grinding adjustment. Axial alignment adjustments of that kind are certainly user-friendly and do not cause significant reduction in machine stiffness; however, they are technically complicated and need a full CNC axis.

What is needed starting from the prior art as represented by DE 20 2008 016 620 U1, is a device for grinding, precision-grinding and/or polishing of workpieces in optical quality, particularly of spherical lens surfaces in precision optics, which has equipment for cross-grinding adjustment, which is designed as simply and economically as possible and which does not impair the stiffness of the device overall.

SUMMARY OF THE INVENTION

According to an aspect of the invention, a device for grinding, precision-grinding and/or polishing of workpieces in optical quality, particularly of spherical lens surfaces in precision optics, includes a machine frame, a tool spindle, by which a tool is rotationally drivable about a tool axis A of rotation, and a workpiece spindle, by which the workpiece is rotationally drivable about a workpiece axis C of rotation. The tool spindle and the workpiece spindle are axially relatively adjustable (X axis, Z axis) in the first and second directions (x, z) extending perpendicularly to one another and in addition are pivotable relative to one another about a pivot axis B in a pivot plane X-Z. In addition, equipment for cross-grinding adjustment includes an adjusting mechanism by way of which one of the spindles is so positionable at least in a third direction y extending perpendicularly to the first and second directions x, z that the tool axis A of rotation and the workpiece C of rotation are located in the pivot plane X-Z. The workpiece spindle is axially adjustable (X axis, Z axis) in the first and second directions x, z and pivotable about the pivot axis B. The equipment for cross-grinding adjustment engages the workpiece spindle and includes a clamping mechanism, which is activatable independently of the adjusting mechanism and which serves the purpose of fixing the workpiece spindle, positioned by the adjusting mechanism, with respect to the machine frame.

In other words, according to one aspect of the invention all processing movements (X, Z and B axes) are provided on the tool side, while only the cross-grinding adjustment is associated with the workpiece side, with the further feature that the clamping mechanism for fixing the workpiece spindle relative to the machine frame after cross-grinding adjustment is independent of or separate from the actual adjusting mechanism for cross-grinding adjustment. This has the consequence that the movement possibility or positioning possibility, which is available for the cross-grinding adjustment, in the third direction y does not in any way diminish the processing-relevant stiffness of the device.

Further, the adjusting mechanism of the equipment for cross-grinding adjustment by contrast to the prior art does not have to accept or withstand any processing forces, since this function is assigned to the clamping mechanism. Consequently, the components of the adjusting mechanism also do not have to be designed and dimensioned with respect to the magnitude of the processing forces, but can be designed to be comparatively 'unstable', thus simple and economic.

Since, moreover, only small setting travels in the third direction y are necessary for the cross-grinding adjustment (short-stroke linear movement), the workpiece spindle is arranged almost in stationary location in the machine frame, which permits, inter alia, optimization of the workspace with respect to, for example, best possible outflow of the liquid grinding or polishing medium. In addition, sealing of the workspace relative to the environment at the workpiece spindle can be effected very simply and, thus, economically. Complicated bellows, labyrinth seals or the like, such as would be necessary in the case of large relative movements, are here unnecessary. Additionally, the adjusting mechanism of the equipment for cross-grinding adjustment can be arranged at a place of the machine frame readily accessible to the user.

The device preferably includes a sleeve in which the workpiece spindle is received with play in at least the third direction y and which is fastened to the machine frame and has an upper, annular support surface on which the workpiece spindle rests by a spindle flange. The spindle flange can be selectably drawn by the clamping mechanism against the support surface in order to fix the workpiece spindle relative to the machine frame. Advantageously, in this design the intrinsic weight of the workpiece spindle assists frictional fixing of the workpiece spindle relative to the machine frame. Because the annular support surface of the sleeve completely surrounds the workpiece axis C of rotation a very stiff coupling of the workpiece spindle, which is tightened or clamped by way of the spindle flange, to the machine frame is achieved.

The arrangement can here advantageously be such that the spindle flange, when the clamping mechanism is deactivated and during positioning of the workpiece spindle by the adjusting mechanism, is displaceable on the support surface of the sleeve, wherein the support surface supports the workpiece spindle in the second direction z, thus defines a 'thrust plane' for the workpiece spindle. The support surface of the sleeve thus has not only a force-absorbing function, but also a guide function. Additional guide elements or the like acting in the second direction z are accordingly superfluous.

If a special guidance of the workpiece spindle also in the third direction y should be desired or in the respective application, for example depending on the respective design of the adjusting mechanism of the equipment for cross-grinding adjustment, be required, it is basically possible to construct the sleeve as seen in cross-section in such a way, for example in oval form, that the inner wall surface of the sleeve has a guidance function in the third direction y. However, the sleeve is preferably of rotationally symmetrical construction, in which case provided for the workpiece spindle between the sleeve and the spindle flange is a guide arrangement serving the purpose, when the clamping mechanism is deactivated and during positioning of the workpiece spindle by the adjusting mechanism, of guiding the workpiece spindle relative to the machine frame in the third direction y. The sleeve can thus be produced very economically and precisely as a turned part. Rotational angle orientation of the sleeve with respect to the machine frame during mounting thereof on the machine frame is not required.

The guidance arrangement between spindle flange and sleeve can in principle be formed by a conventional guidance system such as a V-guide or dovetail-guide. However, with respect to simple capability of production and assembly of the guidance arrangement it is preferred if the guidance arrangement has at the spindle flange or the sleeve at least two slots or grooves, which extend in the third direction y and in which guide pins, which are provided at the respective upper part and advantageously are cylindrical, closely engage, i.e. substantially free of play.

Various components or subassemblies are conceivable for frictional tightening or clamping of the workpiece spindle to the sleeve, for example eccentric or wedge systems, which engage the workpiece spindle in suitable manner. However, a construction of the device is preferred in which the sleeve has a lower, annular support surface axially opposite a clamping ring fastened to the workpiece spindle, wherein the clamping mechanism has at least one, optionally annular, piston-cylinder arrangement, which is arranged between the support surface and the clamping ring to be effective in terms of actuation and which when acted on by pressure urges the clamping ring away from the support surface and thus draws the spindle flange against the support surface of the sleeve. This enables, in advantageous manner, quasi movement-free tightening or clamping, which is produced by fluid pressure, of the workpiece spindle in its cross-grinding adjusted position without forces in that case being applied transversely to the workpiece axis C of rotation, which forces could lead to an undesired transverse displacement of the workpiece spindle.

In a preferred embodiment, which is particularly favorable in terms of energy, of the device in that case a plurality of piston-cylinder arrangements, which are preferably uniformly distributed around the circumference, is provided between the support surface and the clamping ring, the arrangements being able to be acted on pneumatically. Hydraulics could indeed also be used for fluid-actuated tightening or clamping of the workpiece spindle relative to the machine frame, but pneumatics are preferred with respect to simple sealing; moreover, compressed air is in any case present at the grinding or polishing machine.

In further pursuance of one aspect of the invention, the machine frame can be cast from a polymer concrete, wherein the sleeve is cast in place in the machine frame by shape locking. This leads to a very stiff coupling of the sleeve and thus of the workpiece spindle, which is clamped relative to the sleeve by the clamping mechanism, to the machine frame, with good damping of vibrations, which is advantageous for the grinding or polishing process with respect to accuracy and edge-zone damage of the processed workpieces. By comparison with any subsequent fastening of the sleeve to the machine frame with the assistance of fasteners such as screws or the like the outlay on alignment and assembly is also very much less in the case of form or shape-locking casting of the sleeve in place in the machine frame.

Various solutions are conceivable for the actual adjustment or displacement, which is as finely sensitive as possible, of the released workpiece spindle with respect to the machine frame in the third direction y, for example worm or ball-screw drives, optionally with further translation elements (for example, planetary transmissions, belt or chain translations), in order to produce, with comparatively large rotational movements, only small axial travels in the third direction y. On the other hand, a design of the device is preferred in which the adjusting mechanism includes a setting shaft, which extends substantially in the third direction y and is mounted on the machine frame to be axially fixed, but rotatable, and which carries at one end a fine thread which engages with a threaded nut, which is fixedly mounted on the workpiece spindle, to be effective in terms of actuation. The other end of the setting shaft is provided with a handle for manual rotation of the setting shaft. In this fashion, a simple and economic, yet sufficiently precise mechanical solution with low backlash is possible that has basically only two parts, namely a screw and a nut.

With respect to simple assembly and low costs, it is also preferable if the setting shaft is supported merely on one side on the machine frame near the handle. This 'flexible' mounting of the setting shaft compensates for possible directional error and due to the fact that the adjusting mechanism of the equipment for cross-grinding adjustment, as a consequence of the functional and structural separation of the adjusting mechanism from the clamping mechanism of the equipment for cross-grinding adjustment, does not have to accept or withstand any processing forces of the device.

In an equally preferred embodiment of the device, the threaded nut of the adjusting mechanism is mounted close to the spindle flange of the workpiece spindle as seen in the second direction z. As a consequence of the arrangement of the threaded nut near the workpiece, only very short lever arms arise at the spindle flange, i.e. the location of the support of the workpiece spindle relative to the machine frame. This leads to an only very small tendency to tipping or shifting of the workpiece spindle in the case of action of heat, i.e. thermal expansions in the device.

Moreover, the handle for manual rotation of the setting shaft can be formed by a hexagon socket screw mounted at the setting shaft. This is not only favorable with regard to costs, but also advantageous insofar as unintended rotation of the setting shaft, which would perhaps be possible in the case of a handwheel, which is fixedly mounted on the setting shaft, as handle, is excluded. Moreover, hexagon socket keys are in any case part of the 'tool kit' of grinding or polishing machines in order to fix workpiece mounts or polishing bowls or grinding tools in the usual hydro expansion chucks of workpiece or tool spindles. Thus, an additional tool for the cross-grinding adjustment is not needed.

In order to improve the repeatability of the cross-grinding adjustment and simplify the latter a distance sensor, which is fastened to the machine frame, for detection of displacement of the workpiece spindle relative to the machine frame in the third direction y can additionally be provided. In that regard, detected absolute values of the workpiece spindle position in the machine frame are of less importance than relative values for the adjustment travel, which allow 'recalculation' of the setting shaft rotations into the setting travel achieved at the workpiece spindle, according to which for correctness of the cross-grinding adjustment ultimately the processing or grinding pattern M (cf. FIGS. 10 to 12) achieved at a sample workpiece is decisive.

Finally, the distance sensor can be a tactile measured probe engaging the workpiece spindle. Such measuring probes are not only economically available in commerce, but also more robust by comparison with other, equally conceivable sensor solutions such as, for example, contactlessly operating inductive, capacitive or Hall sensors.

BRIEF DESCRIPTION OF THE DRAWINGS

The invention is explained in more detail in the following on the basis of a preferred embodiment with reference to the accompanying, partly schematic drawings, in which components or subassemblies not appearing necessary for an understanding of the invention, such as hoods, covers, doors and other boundary walls as well as a switchgear cabinet with a CNC control, supply devices and supply lines, etc., have been omitted for simplification of the illustration. In the drawings.

DETAILED DESCRIPTION OF THE EMBODIMENT

Figure 1:
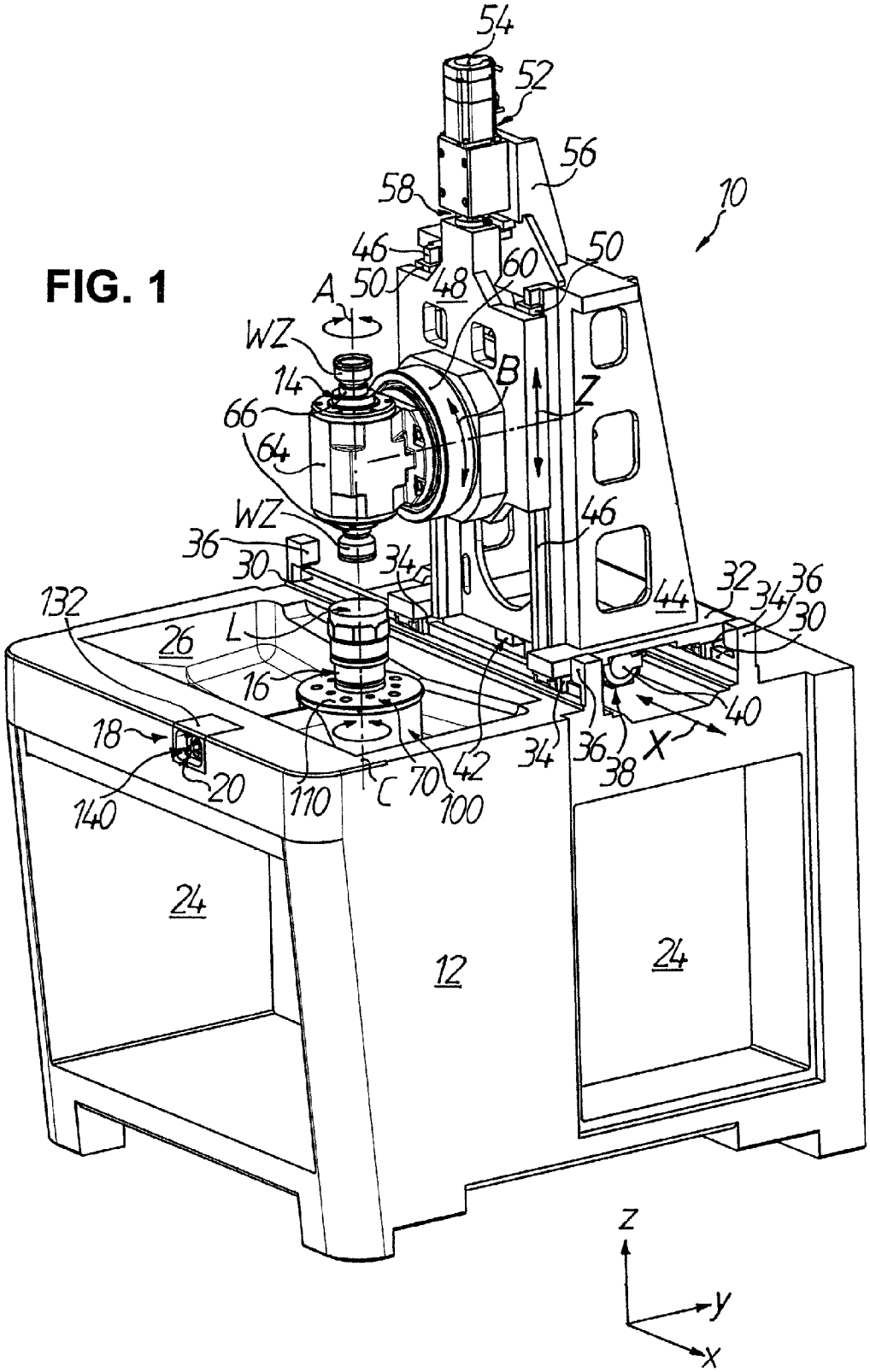
FIG. 1 shows a perspective view of a device according to the invention for grinding, precision-grinding and/or polishing of, in particular, spherical lens surfaces in precision optics obliquely from above and front right, wherein an upper part of the machine frame has been omitted so as to permit a view of parts of the device essential for the machine kinematics.

FIGS. 1 to 4 show in partly schematic illustration a CNC-controlled device 10 for grinding, fine precision-grinding and/or polishing of workpieces in optical quality, particularly of spherical surfaces at lenses L in precision optics, in a right-angled Cartesian co-ordinate system in which the lower-case letters x, y and z respectively denote the width direction (x), length direction (y) and height direction (z) of the device 10.

The device 10 generally comprises a machine frame 12, which cast monolithically from a polymer concrete forms at the same time a machine bed, an upper tool spindle 14, by which at least one tool WZ, in the illustrated embodiment, two tools WZ mounted at opposite ends of the tool spindle 14 is drivable for rotation about a tool axis A of rotation, and a lower workpiece spindle 16, by which the workpiece, i.e. here the lens L, is drivable for rotation about a workpiece axis C of rotation. In this regard, as characterized in the figures by movement arrows, the tool spindle 14 and the workpiece spindle 16 are capable of axial relative adjustment in mutually perpendicularly extending first and second directions, namely the width and height directions x, z of the device 10, and additionally pivotable relative to one another about a, here, horizontally extending pivot axis B in a pivot plane X-Z indicated in FIGS. 10 to 12. According to a significant feature of the device 10 these movement possibilities are realized entirely at the tool side, i.e. the tool spindle 14 is axially adjustable (linear axes X and Z) in the first and second directions x, z and pivotable about the pivot axis B, as will be described in more detail in the following.

Moreover, equipment 18, which is similarly explained further below in more detail, for cross-grinding adjustment is provided, which equipment engages the workpiece spindle 16 and comprises an adjusting mechanism 20 by way of which the workpiece spindle 16 is so positionable in a third direction extending perpendicularly to the first and second directions x, z, namely the length direction y of the device 10, that the tool axis A of rotation and the workpiece axis C of rotation are located in the pivot plane X-Z. According to, in particular, FIGS. 3, 5, 7 and 9 the equipment 18 for cross-grinding adjustment further has a clamping mechanism 22, which is activatable independently of the adjusting mechanism 20 and which serves the purpose of selectably fixing the workpiece spindle 16, which has been positioned by the adjusting mechanism 20, with respect to the machine frame 12 in a mode and manner still to be described.

According to FIGS. 1 to 4 the machine frame 12, which is provided at the sides with recesses 24 for reception of not illustrated here CNC-control components, supply devices and supply lines for liquid grinding or polishing medium, compressed air and current, etc., has on its upper side in a front region a trough-shaped depression 26 with an integrally formed outflow 28 (see FIGS. 3 and 4), into which depression the workpiece spindle 16 projects from below and which depression downwardly bounds a workspace of the device 10 in which the processing engagement between tool WZ and lens L takes place. Mounted in a rear region on the upper side of the machine frame 12 are two guide rails 30 which extend parallel to one another in the (horizontal) width direction x. An X slide 32 is mounted by way of four guide carriages 34, which together with the guide rails 30 form a linear guide, to be displaceable on the guide rails 30 in width direction x towards end abutments 36. A drive 38 is provided for displacement (X axis), under CNC positional control, of the X slide 32 and comprises a servomotor 40 which is flange-mounted on the upper side of the machine frame 12 and which is operatively connected with the X slide 32 in a manner known per se by way of a ball screw drive 42.

A guide bracket 44 is mounted on the X slide 32. For the movements of the tool spindle 14 in the (vertical) height direction z of the device 10 two guide rails 46 extending parallel to one another in height direction z are mounted on the front side of the guide bracket 44 facing the workpiece spindle 16. A Z slide 48 is mounted on the guide rails 46 by way of four guide carriages 50, which together with the guide rails 46 form a further linear guide, to be displaceable in height direction z. For the displacement, under CNC positional control, of the Z slide 48 (Z axis) there is provided a further drive 52 with a servomotor 54, which is flange-mounted on a drive bracket 56 mounted at the top on the guide bracket 44 and which is operatively connected with the Z slide 48 in a manner known per se by way of a further ball screw drive 58.

Figure 2:
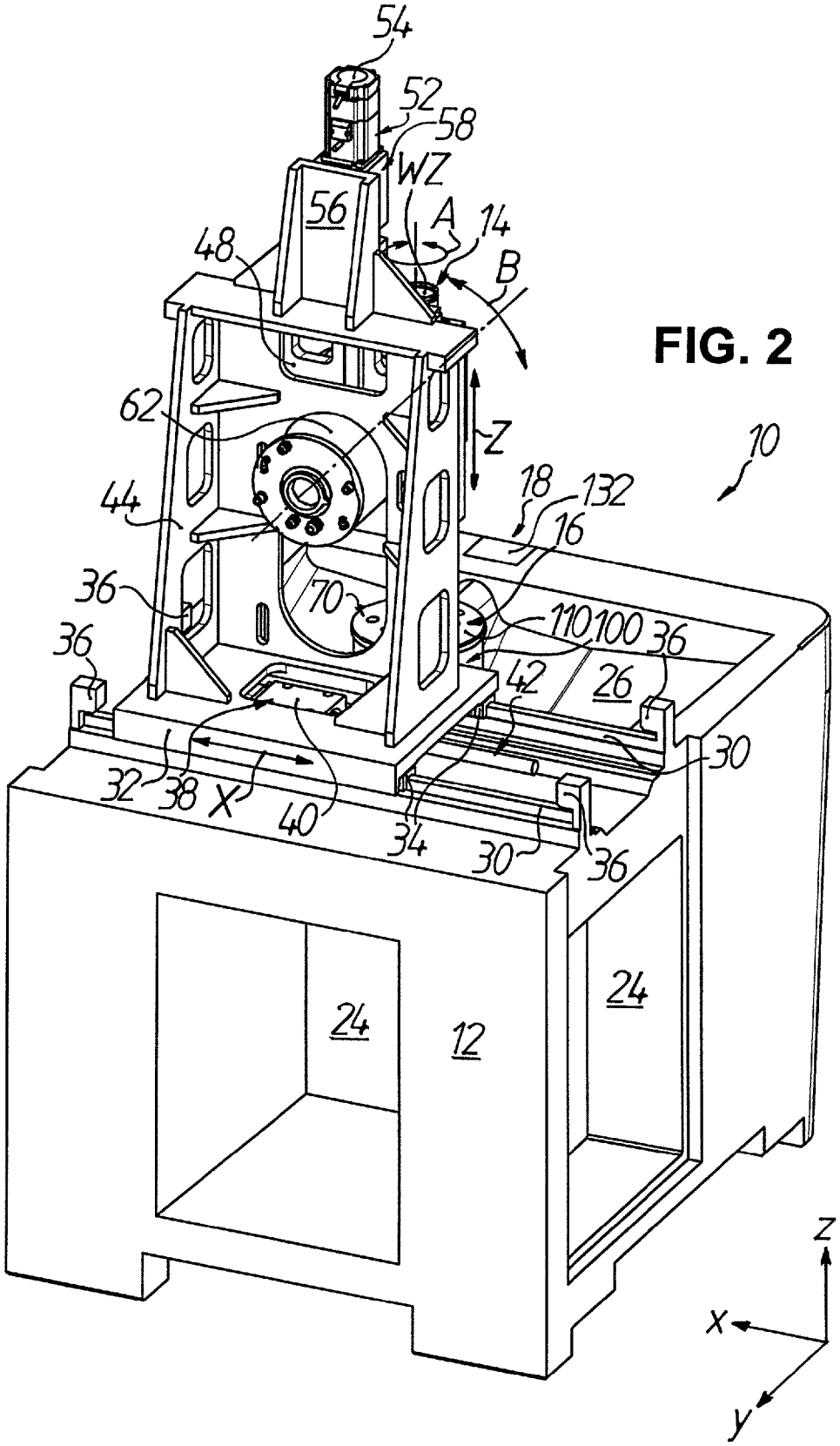
FIG. 2 shows a perspective view of the device according to FIG. 1 obliquely from above and rear right, with the simplifications of FIG. 1.
Figure 3:
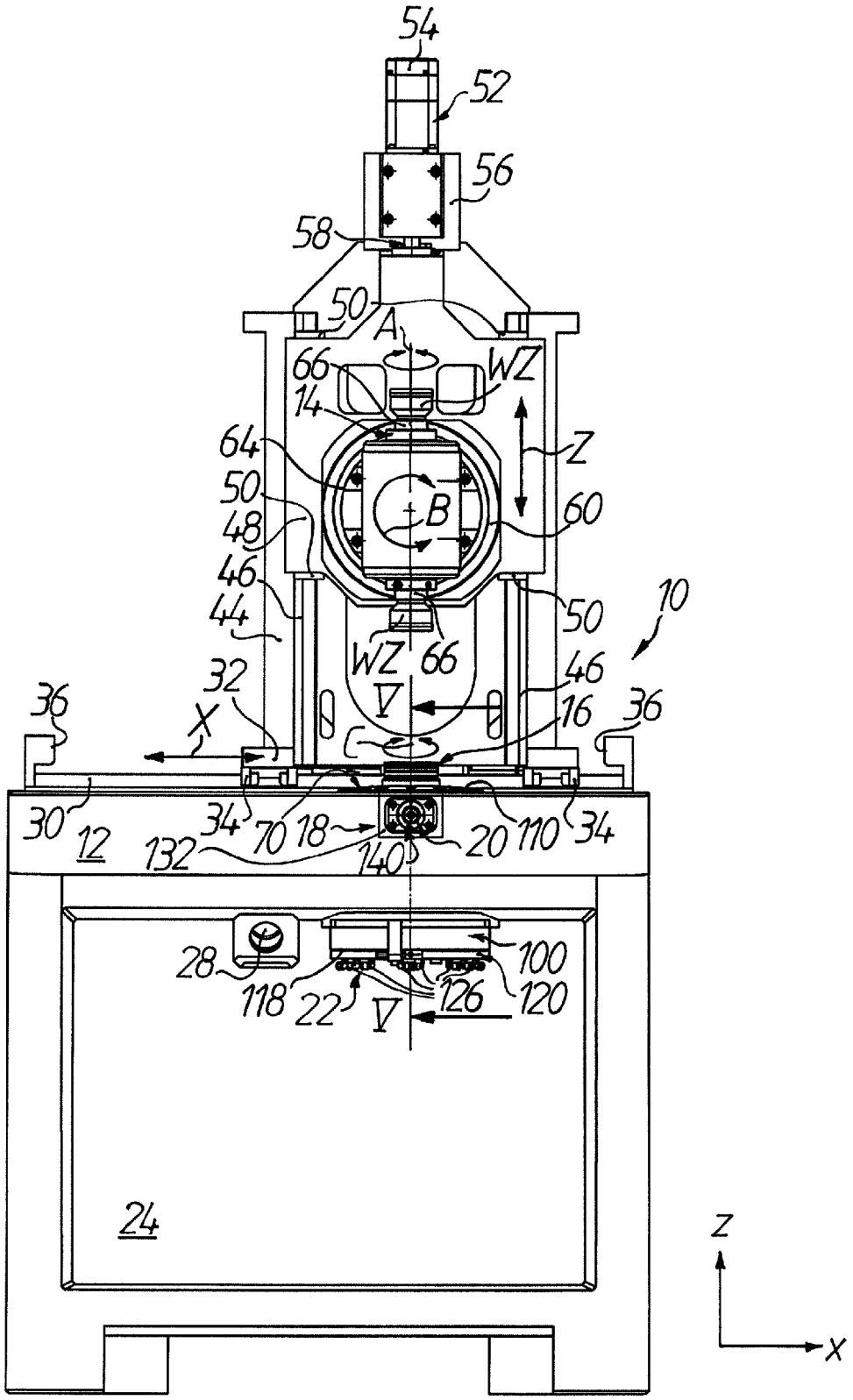
FIG. 3 shows a front view of the device according to FIG. 1, with the simplifications of FIG. 1.
Figure 4:
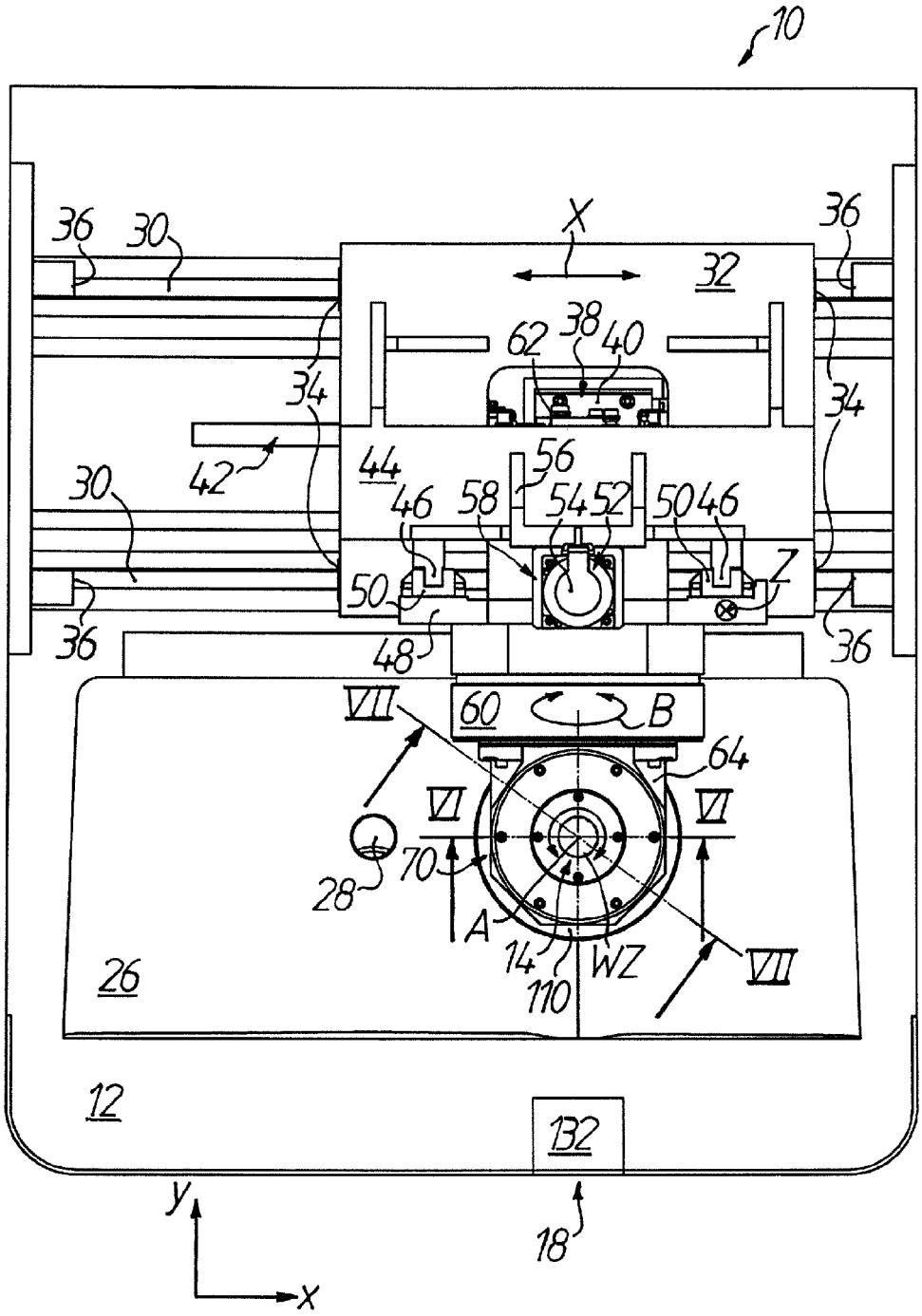
FIG. 4 shows a plan view of the device according to FIG. 1, with the simplifications of FIG. 1.

For the pivot movement, under CNC angular positional control, of the tool spindle 14 about the pivot axis 5 a pivot transmission 60, for example a so-called 'harmonic drive' transmission (not shown in more detail), is mounted on the front side of the Z slide 48 and is operatively connected with a servomotor 62 similarly flange-mounted on the Z slide 48 (see FIG. 2). A pivot head 64, which for its part is constructed to be suitable for fixed mounting of the tool spindle 14, can be pivoted through 360° about the pivot axis B by way of the pivot transmission 60 and the servomotor 62. A spindle shaft, which is drivable for rotation about the tool axis A of rotation under rotational speed control in a manner known per se, of the tool spindle 14 carries a tool mount 66 at both ends, for example a hydro expansion chuck, for the respective tool WZ.

Inductive detectors and switching vanes for referencing the respective movement axes X, Z are provided for the mentioned slides 32, 48, but are not shown in the drawings, since these measures are familiar to one ordinarily skilled in the art. All servomotors or synchronous motors of device 10 can be equipped with resolvers, the signals of which are also used for the position regulating circuits so that additional measuring systems such as linear scales, separate rotational angle transmitters, etc., are basically superfluous.

With respect to description of further details of the workpiece spindle 16 and the mounting thereof on the machine frame 12 as well as the equipment 18 for cross-grinding adjustment with the adjusting mechanism 20 and the clamping mechanism 22 reference is now made primarily to FIGS. 5 to 9.

Figure 5:
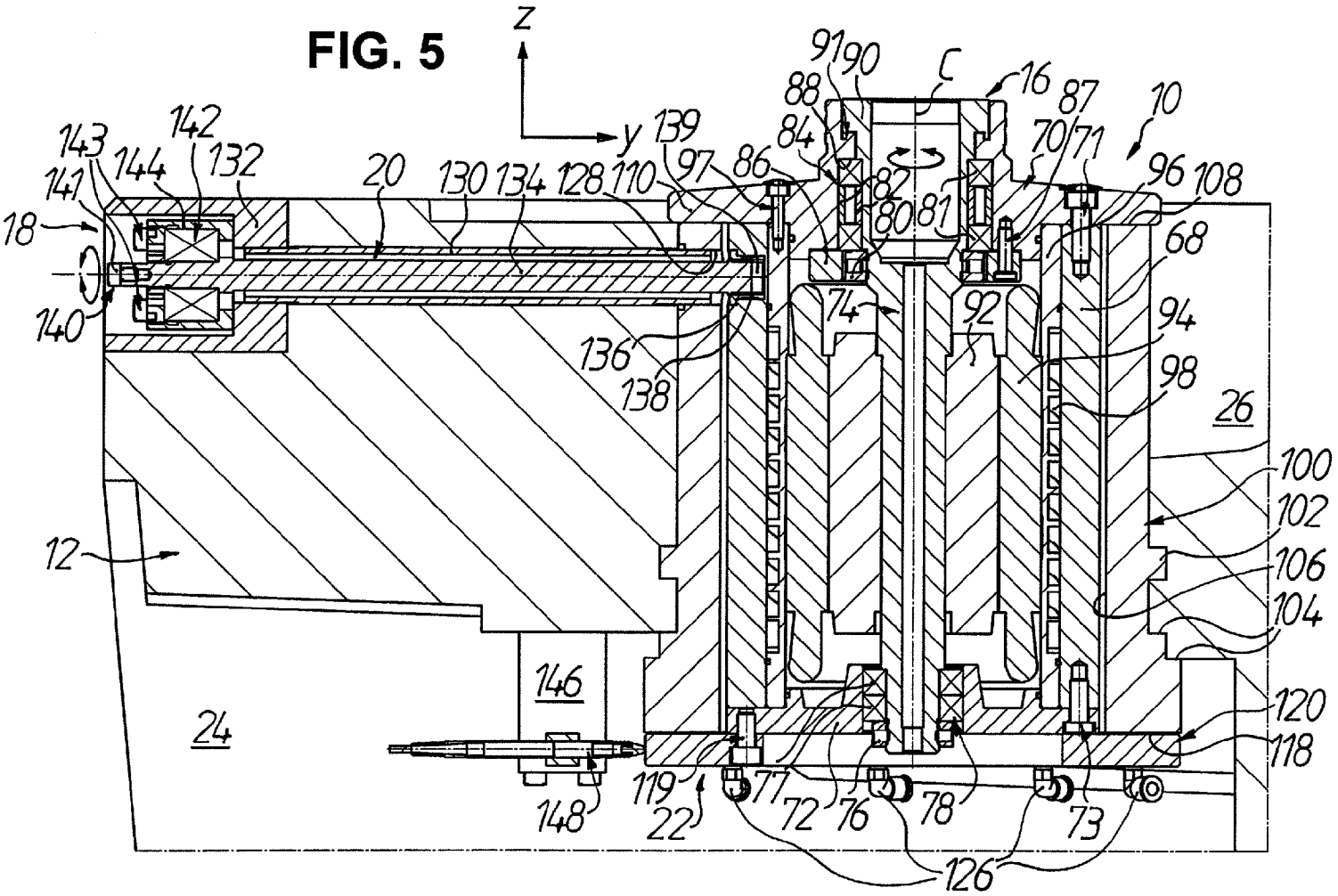
FIG. 5 shows a broken-away sectional view of the device according to FIG. 1 in correspondence with the section line V-V in FIG. 3, for illustration of further details of special equipment for cross-grinding adjustment, in particular the adjusting and clamping mechanisms thereof, which operate independently of one another.
Figure 6:
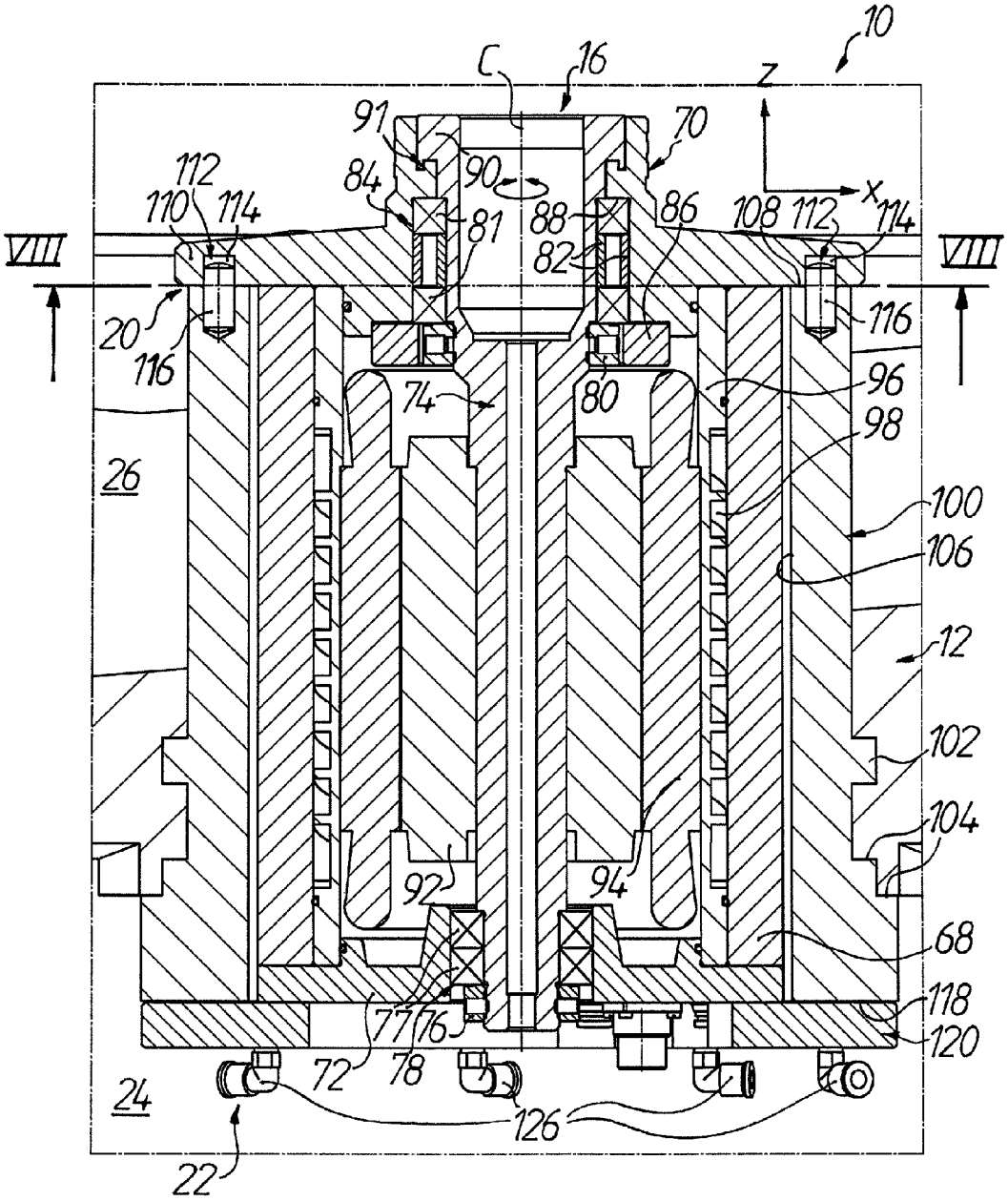
FIG. 6 shows a broken-away sectional view of the device according to FIG. 1 in correspondence with the section line VI-VI in FIG. 4, for illustration of further details of the equipment for cross-grinding adjustment, particularly of guidance measures at the adjusting mechanism.
Figure 7:
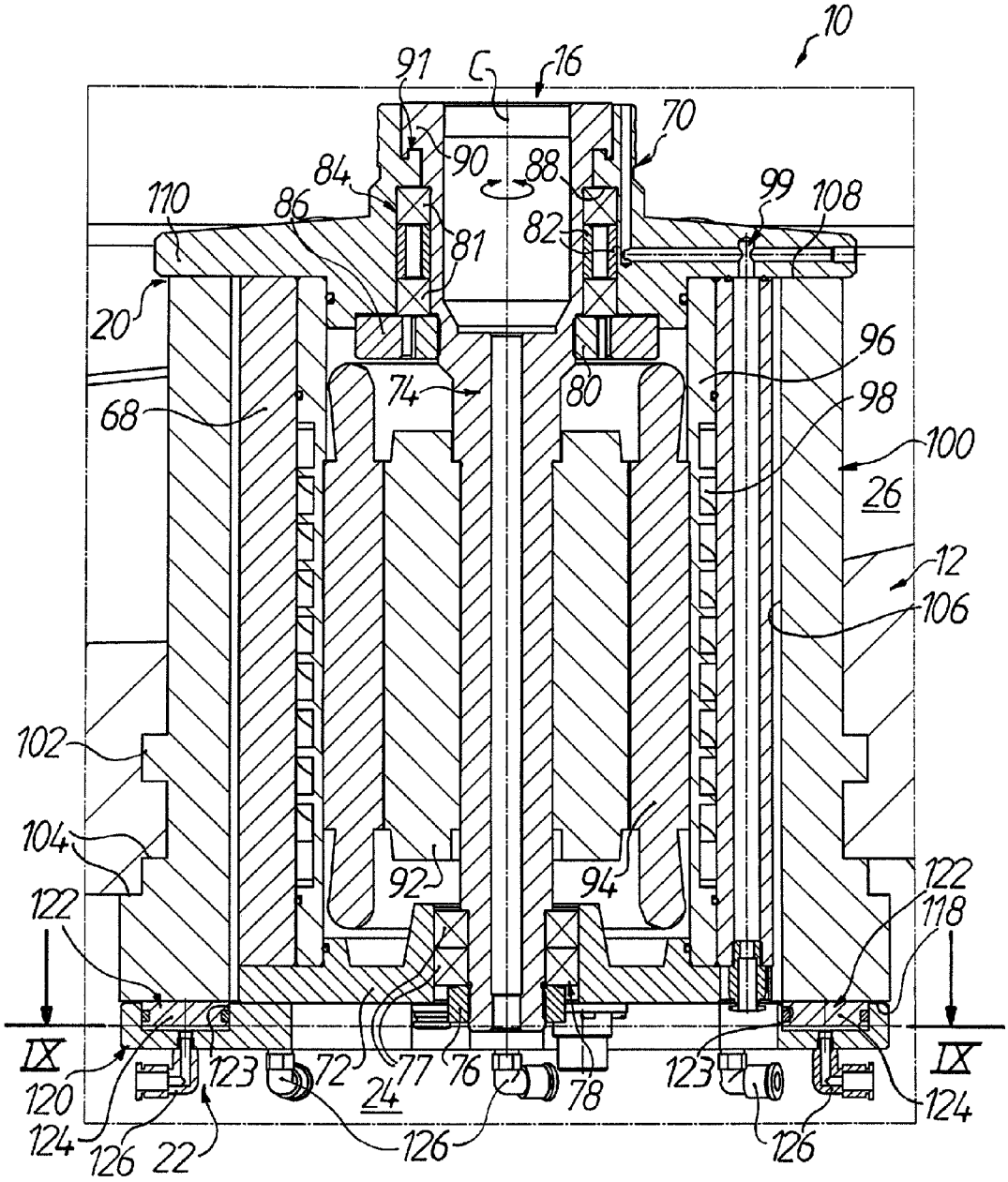
FIG. 7 shows a broken-away sectional view, which is turned in the drawing plane through approximately 35° in counter-clockwise sense, of the device according to FIG. 1 in correspondence with the section line VII-VII in FIG. 4, for illustration of further details of the equipment for cross-grinding adjustment, particularly the clamping mechanism thereof.
Figure 8:
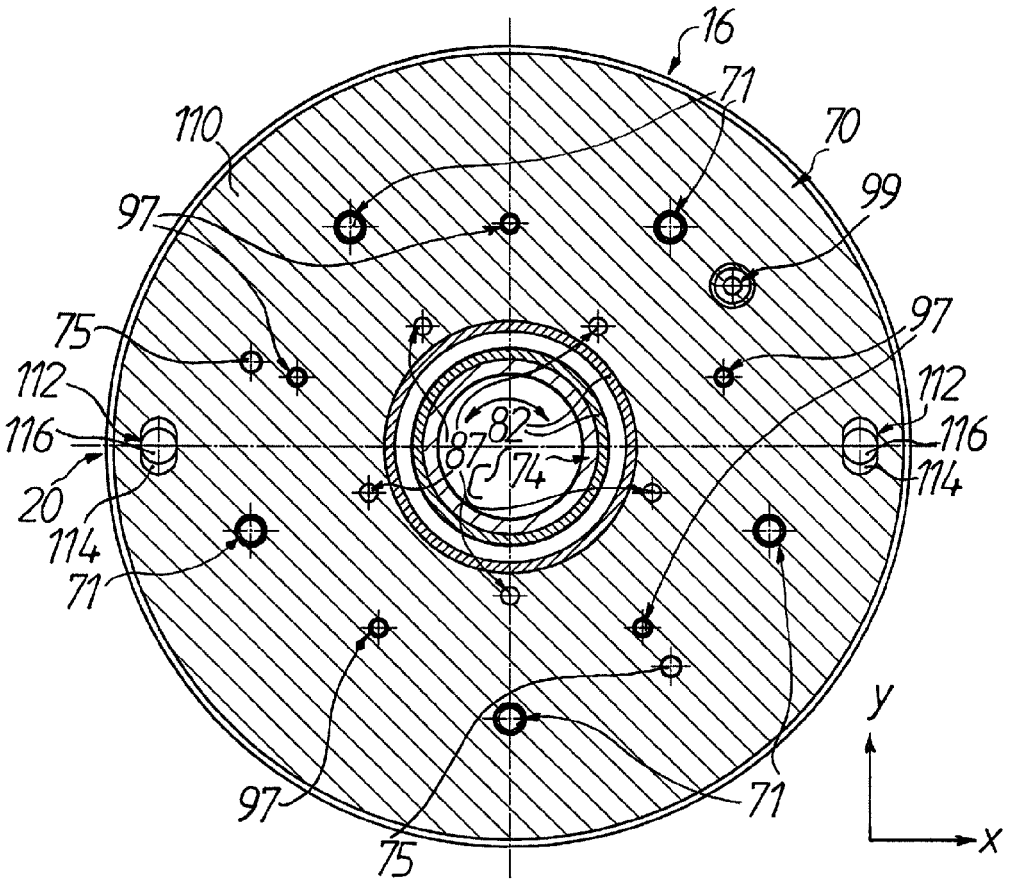
FIG. 8 shows a sectional view of the device according to FIG. 1 in correspondence with the section line VIII-VIII in FIG. 6, from which further details with respect to the guidance measures at the adjusting mechanism of the equipment for cross-grinding adjustment can be inferred.

According to FIGS. 5 to 7, the actual housing of the workpiece spindle 16 is formed by an annular cylindrical spindle sleeve 68, which bounds the workpiece spindle 16 in radial direction, and an upper flange part 70 and a lower bearing plate 72, which bound the workpiece spindle 16 in axial direction and are screw-connected at the end with the spindle sleeve 68 (at 71 or 73 in FIGS. 5 and 8). The flange part 70 and the bearing plate 72 are each provided with a respective central bore which is penetrated by a hollow spindle shaft 74 of the workpiece spindle 16. According to FIG. 8, the flange part 70 is oriented in angle with respect to the spindle sleeve 68 by way of two cylinder pins 75.

Two spindle bearings 77, which in the associated central bore of the bearing plate 72 form a loose bearing arrangement 78, are fastened to the end, which is at the bottom as shown in FIGS. 5 to 7 and has a stepped outer diameter, of the spindle shaft 74 by a spindle nut 76 screwed onto a threaded section of the spindle shaft 74. Two further spindle bearings 81, which spaced by spacer rings 82 form a fixed bearing arrangement 84 in the associated central bore of the flange part 70, are fastened to the end, which is at the top as shown in FIGS. 5 to 7 and which is mounted in a stepped outer diameter of the spindle shaft 74 by a further spindle nut 80 screwed onto a threaded section of the spindle shaft 74. The fixed bearing arrangement 84 is in that case drawn by a bearing ring 86, which is screw-connected with the flange part 70 (at 87 in FIGS. 5 and 8), against a shoulder 88 in the central (stepped) bore of the flange part 70. The end, which is at the top in FIGS. 5 to 7, of the spindle shaft 74 comprises a hydro expansion chuck 90 (details not shown) for clamping the workpiece to the workpiece spindle 16 and is sealed at 91 relative to the flange-part 70 by a labyrinth seal.

The spindle shaft 74 carries at the outer circumference a magnetic rotor 92 which co-operates in a manner known per se with a wound stator 94 surrounding the rotor 92, for driving rotation in a controlled fashion about the workpiece axis C of rotation. Inserted between the stator 94 and the spindle sleeve 68 is a cooling jacket 96 which is similarly screw-connected with the flange part 70 (at 97 in FIGS. 5 and 8) and is provided at the outer circumference with a helical groove 98 for water-cooling of the stator 94. The reference numeral 99 additionally denotes in FIGS. 7 to 9 a blocking air channel system 99, which is known per se, in the workpiece spindle 16.

According to FIGS. 1 to 3 and 5 and 7, a metallic sleeve 100 for receiving the workpiece spindle 16 is fastened to the machine frame 12. More precisely, the sleeve 100 is cast in place in interlocking manner in the polymer concrete of the machine frame 12, for which purpose the sleeve 100 according to FIGS. 5 to 7 is provided at the outer circumference with a collar 102 and steps 104. The workpiece spindle 16 is received in the sleeve 100 with radial play relative to the hollow-cylindrical inner circumferential surface 106 of the sleeve 100 so that the workpiece spindle 16 has play in the sleeve 100 in the third length direction y of the device 10, as can be seen in FIG. 5. The sleeve 100 has an upper, annular and planar support surface 108 on which the workpiece spindle 16 rests by a spindle flange 110, which projects radially at all sides beyond the spindle sleeve 68 of the flange part 70. As will be described in more detail in the following, the spindle flange 110 can be selectably drawn against the support surface 108 of the sleeve 100 by the clamping mechanism 22 of the equipment 18 for cross-grinding adjustment so as to fix the workpiece spindle 16 relative to the sleeve 100 and thus the machine frame 12. Conversely, when the clamping mechanism 22 is deactivated and during positioning of the workpiece spindle 16 by the adjusting mechanism 20 of the equipment 18 for cross-grinding adjustment, the spindle flange 110 is displaceable on the support surface 108 of the sleeve 100, in which case the support surface 108 supports the workpiece spindle 16 in the second, height direction z of the device 10.

In addition, a guide arrangement 112 is provided for the workpiece spindle 16 between the sleeve 100, which is preferably constructed rotationally symmetrically as a turned part, and the spindle flange 110 and serves the purpose, when the clamping mechanism 22 is deactivated and during positioning of the workpiece spindle 16 by the adjusting mechanism 20 of the equipment 18 for cross-grinding adjustment, of guiding the workpiece spindle 16 relative to the sleeve 100 and, thus, the machine frame 12 in the third length direction y of the device 10. In the illustrated embodiment the guide arrangement 112 according to FIGS. 6 and 8 has on the underside of the spindle flange 110 and on sides diametrically opposite the workpiece spindle 16 two grooves 114 which extend in the third length direction y of the device 10 and in which cylindrical guide pins 116 which are provided at the sleeve 100, more precisely press-fitted in blind bores at the support surface 108 of the sleeve 100 tightly engage, i.e. substantially free of play.

Figure 9:
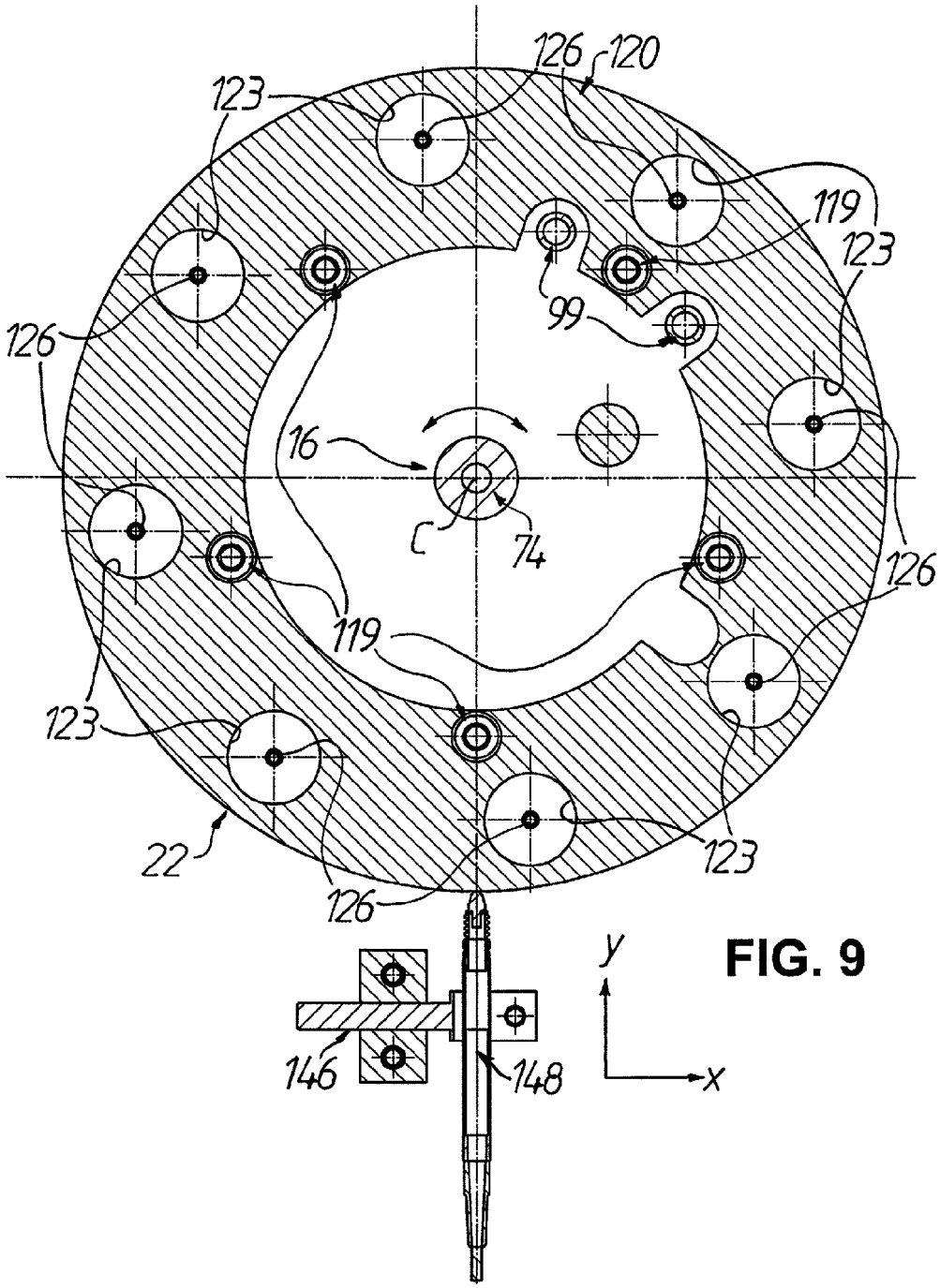
FIG. 9 shows a sectional view of the device according to FIG. 1 in correspondence with the section line IX-IX in FIG. 7, from which further details with respect to the clamping mechanism of the equipment for cross-grinding adjustment can be inferred.

Further details of the clamping mechanism 22 of the equipment 18 for cross-grinding adjustment are inferrable from, in particular, FIGS. 5, 7 and 9. According thereto, the sleeve 100 has a lower, annular and planar support surface 118 which is disposed axially opposite a clamping ring 120, which is fastened to the workpiece spindle 16 more precisely, screw-connected with the bearing plate 72 of the workpiece spindle 16 at 119 and which protrudes radially beyond the bearing plate 72. In that regard, the clamping mechanism 22 further comprises at least one, in the illustrated embodiments several, namely eight, piston-cylinder arrangements 122, which are uniformly distributed around the circumference and which are arranged between the support surface 118 and the clamping ring 120 to be effective in terms in actuation. The respective cylinder wall of the piston-cylinder arrangements 122 is defined by a blind bore 123 in the clamping ring 120, whereas the piston 124 of each piston-cylinder arrangement 122 is a commercially available clamping disc with high-pressure seal vulcanized in place, such as available from, for example, the company MET-RON® Messtechnik and Maschinenbau GmbH, Essen, Germany. Each piston-cylinder arrangement 122 can be acted on by a fluid pressure, here pneumatically, via a pressure connection 126 with an L-screw-connection, the connection being provided in the clamping ring 120 at the base of the blind bore 123. When the piston-cylinder arrangements 122 are acted on by pressure the pistons 124 are urged against the support surface 118 of the sleeve 100, which in reaction has the consequence that the clamping ring 120 at the bottom is urged away from the support surface 118 and, thus, the spindle flange 110 at the top is drawn against the support surface 108 of the sleeve 100, whereby the workpiece spindle 16 is fixed by friction couple to the sleeve 100 and thus relative to the machine frame 12.

Further details of the adjusting mechanism 20 of the equipment 18 for cross-grinding adjustment are apparent from, in particular, FIG. 5. In the first instance, the sleeve 100 is provided near the support surface 108 on its side facing the front side of the device 10 with a passage bore 128 into which an end of a pipe 130 is inserted, which extends in the third length direction y of the device 10 towards the front side thereof and is there inserted by its other end into a bearing housing 132. The pipe 130 and the bearing housing 132 are, just as the sleeve 100, cast in place in the polymer concrete of the machine frame 12 to be fixed by interlocking.

The pipe 130 serves for reception of a setting shaft 134 of the adjusting mechanism 20 of the equipment 18 for cross-grinding adjustment, which shaft extends substantially in the third length direction y of the device 10 and is mounted on the machine frame 12 to be axially fixed, but rotatable. The end, which extends through the passage bore 128 in the sleeve 100 and is on the right in FIG. 5, of the setting shaft 134 carries a fine thread 136 engaged with a threaded bush 138 to be effective in terms of actuation, which bush is fixedly mounted on the workpiece spindle 16, more precisely glued in place in a receiving recess 139 in the spindle sleeve 68. The other end, on the left in FIG. 5, of the setting shaft 134 is provided with handle 140 for manual rotation of the setting shaft 134, the handle in the illustrated embodiment being formed by a hexagon socket screw 141 mounted at the end on the setting shaft 134 and being accessible from the front side of the device 10 for a hexagon key.

The setting shaft 134 is rotatably supported merely at one end on the machine frame 12 near the handle 140, more specifically in the bearing housing 132 fastened to the machine frame 12, in particular by a fixed bearing arrangement 142, which has two roller bearings and which is received in a bearing bush 144 screw-connected with the bearing housing 132 at 143.

It is evident that the workpiece spindle 16, when the clamping mechanism 22 of the equipment 18 for cross-grinding adjustment is released, can be adjusted by the adjusting mechanism 20 thereof in the third length direction y of the device 10, wherein the workpiece spindle 16 in the case of manual rotation of the setting shaft 134 in one rotational direction is pushed in the third length direction y as a consequence of the threaded engagement between fine thread 136 and threaded bush 138 and in the case of rotation in the opposite rotational direction is pulled. In that case, the workpiece spindle 16 is supported by way of its spindle flange 110, as seen in the height direction z of the device 10, on the support surface 108 of the sleeve 100 and is guided by way of the guide arrangement 112 between the support surface 108 and spindle flange 110 in the length direction y of the device 10. Due to the fact that the threaded bush 138 is mounted on the spindle sleeve 68 of the workpiece spindle 16 near the spindle flange 110 as seen in the height direction z the displacing movement of the workpiece spindle 16 is not perceptibly hindered by canting moments.

Finally, in FIGS. 5 and 9, it is illustrated even more schematically that the displacement, which is produced by the adjusting mechanism 20, of the workpiece spindle 16 relative to the machine frame 12 in the third length direction y of the device 10 can be detected by a distance sensor fastened to the machine frame 12 by way of a mount 146, the sensor in the illustrated embodiment being a tactile measuring probe 148 which is aligned in the length direction y and which engages at a suitable location of the workpiece spindle 16 or at components fixed to the workpiece spindle, such as, for example, the clamping ring 120 as shown. The detected y-position values can be displayed to the user of the device 10 by way of the display of the CNC control (not illustrated) so as to facilitate the cross-grinding adjustment and ensure good repeatability.

Figure 10:
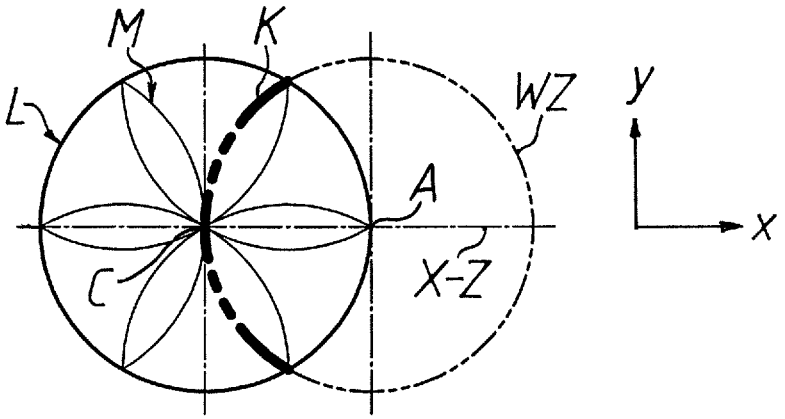
FIG. 10 shows a plan view of a spherical lens L, with which a cutting edge WZ, indicated by dot-dashed lines, of a cup grinding wheel is in processing engagement, for illustration of the grinding pattern M on the lens L, which pattern in the case of grinding work with correct cross-grinding adjustment arises as a consequence of the thickly depicted contact line K, which in this case goes over the entire lens width, between lens L and cutting edge WZ, wherein the cutting edge WZ for the sake of simplicity has been illustrated as a circular line, but due to the lead angle of the cup grinding wheel with respect to the lens L actually has, as seen in projection, an elliptical form.
Figure 11:
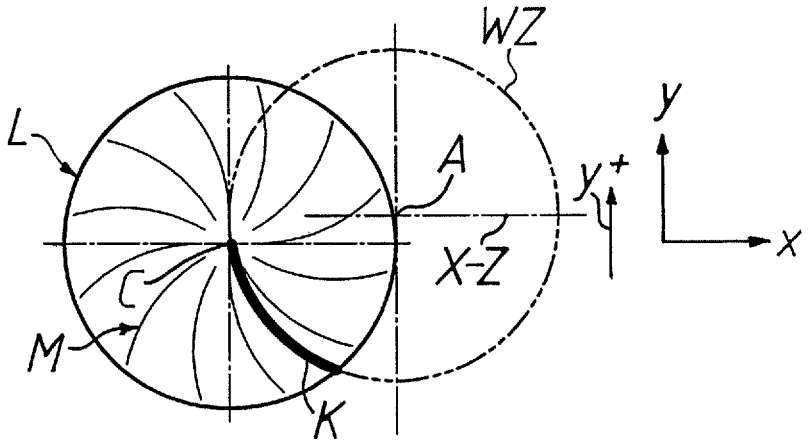
FIG. 11 shows a plan view of a spherical lens L analogously to FIG. 10, but differing therefrom by faulty cross-grinding adjustment, in which due to the downwardly displaced, incomplete contact line K between lens L and cutting edge WZ a different grinding pattern M on the lens L arises, wherein the direction in which the workpiece axis C of rotation has to be displaced relative to the tool axis A or rotation in order to correctly set the cross-grinding is indicated by an arrow $y^+$.
Figure 12:
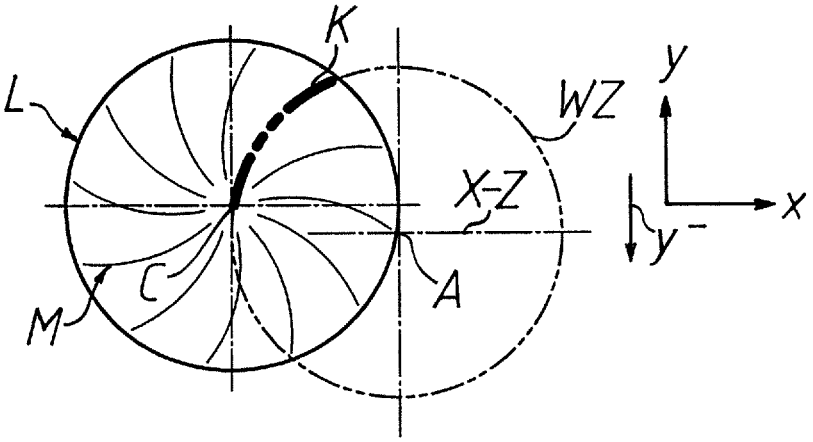
FIG. 12 shows a plan view of a spherical lens L analogously to FIG. 10, again with faulty cross-grinding adjustment, in which this time, however, due to the upwardly displaced, incomplete contact line K between the lens L and cutting edge WZ a different again grinding pattern M on the lens L arises, wherein the arrow y shows the direction in which the workpiece axis C of rotation has to be displaced relative to the tool axis A of rotation for correct setting of the cross-grinding.

As already explained in the introduction, FIGS. 10 to 12 show grinding patterns which arise on a surface, which has been ground by a cup grinding wheel (WZ), of a spherical lens L when the cross-grinding is correctly adjusted (FIG. 10) or is not adjusted or is incorrectly adjusted (FIGS. 11 and 12).

If, in the case of a correct cross-grinding setting, the tool axis A of rotation and the workpiece axis C of rotation are located in the pivot plane X-Z, the 'flower pattern' M illustrated in FIG. 10 arises. If, however, the workpiece axis C of rotation does not lie in the pivot plane X-Z of the tool axis A of rotation there arises, depending on the amount of direction deviation in y, a 'rotationally oriented pattern' M, either in clockwise sense (FIG. 11) or counter-clockwise sense (FIG. 12), which signals both the incorrect cross-grinding setting and a necessary corrective direction. In the case of FIG. 11 a displacement of the workpiece axis C of rotation in direction $y^+$ or, conversely, in the case of FIG. 12 a displacement in direction $y^-$ must then be carried out by the equipment 18 for cross-grinding adjustment.

For that purpose, as already discussed above, initially the clamping mechanism 22 of the equipment 18 for cross-grinding adjustment is released, thus relieved of pressure, so as to enable displacement of the tool spindle 16 together with its spindle flange 110 on the support surface 108 of the sleeve 100. The workpiece spindle 16 is then suitably displaced in the length direction y by the adjusting mechanism 20 of the equipment 18 for cross-grinding adjustment by manual rotation of the setting shaft 134 within the scope of only several millimeters of radial play between the outer circumferential surface of the spindle sleeve 68 of the workpiece spindle 16 and the inner circumferential surface 106 of the sleeve 100 fixed to the machine frame. The clamping mechanism 22 is then again acted on by pressure so as to again fix the workpiece spindle 16 in its displaced setting with respect to the machine frame 12 as described by force or friction couple between the spindle flange 110 and the support surface 108 of the sleeve 100. A test processing can now be carried out and the grinding pattern M produced in that case checked once more. This procedure is repeated as often as required until the correct grinding pattern according to FIG. 10 arises.

A device for grinding and/or polishing, particularly of precision-optical spherical lens surfaces, comprises a machine frame, a tool spindle for rotational drive of a tool about a tool axis A of rotation and a workpiece spindle for rotational drive of workpiece about a workpiece axis C of rotation. Tool spindle and workpiece spindle are capable of axial relative adjustment in first and second directions x, z extending perpendicularly to one another and in addition pivotable about a pivot axis B relative to one another in a pivot plane, wherein these movements are all executed by the tool spindle (X, Z and B axes). In addition, equipment for cross-grinding adjustment is provided, which comprises an adjusting mechanism by way of which the workpiece spindle is so positionable in a third direction extending perpendicularly to the first and second directions that the axes of rotation of tool and workpiece are located in the pivot plane, and a clamping mechanism which is activatable independently of the adjusting mechanism, and serves the purpose of fixing the workpiece spindle, once positioned, with respect to the machine frame.

Variations and modifications are possible without departing from the scope and spirit of the present invention as defined by the appended claims.

The invention claimed is:

1. A device for grinding, precision-grinding and/or polishing of workpieces in optical quality, particularly of spherical lens surfaces in precision optics, comprising:

a machine frame, a tool spindle, by which a tool is drivable for rotation about a tool axis of rotation, a workpiece spindle by which the workpiece is drivable for rotation about a workpiece axis of rotation, wherein the tool spindle and the workpiece spindle are capable of axial relative adjustment in first and second directions extending perpendicularly to one another and in addition are pivotable relative to one another in a pivot plane about an axis of pivotation, equipment for cross-grinding adjustment, which comprises an adjusting mechanism by way of which one of the spindles is so positionable in at least one third direction extending perpendicularly to the first and second directions that the tool axis of rotation and the workpiece axis of rotation are located in the pivot plane, and, characterized in that the tool spindle is axially adjustable in the first and second directions and is pivotable about the pivot axis, whereas the equipment for cross-grinding adjustment engages the workpiece spindle and comprises a clamping mechanism, which is activatable independently of the adjusting mechanism and serves the purpose of fixing the workpiece spindle positioned by the adjusting mechanism, with respect to the machine frame.

2. A device according to claim 1, characterized by a sleeve, in which the workpiece spindle is received with play in at least the third direction and which is fastened to the machine frame and has an upper, annular support surface, on which the workpiece spindle rests by a spindle flange, wherein the spindle flange can be selectably drawn by the clamping mechanism against the support surface in order to fix the workpiece spindle relative to the machine frame.

3. A device according to claim 2, characterized in that the spindle flange is displaceable on the support surface of the sleeve when the clamping mechanism is deactivated and during positioning of the workpiece spindle by the adjusting mechanism, wherein the support surface supports the workpiece spindle in the second direction.

4. A device according to claim 3, characterized in that the sleeve is of rotationally symmetrical construction, and provided for the workpiece spindle between the sleeve and the spindle flange is a guide arrangement serving the purpose of guiding the workpiece spindle relative to the machine frame in the third direction when the clamping mechanism is deactivated and during positioning of the workpiece spindle by the adjusting mechanism.

5. A device according to claim 4, characterized in that the guide arrangement has at the spindle flange or the sleeve at least two slots or grooves, which extend in the third direction and in which guide pins provided at the respective other part tightly engage.

6. A device according to claim 5, characterized in that the sleeve has a lower, annular support surface, which is axially opposite a clamping ring fastened to the workpiece spindle, wherein the clamping mechanism comprises at least one, optionally annular, piston-cylinder arrangement, which is arranged between the support surface and the clamping ring to be effective in actuation and which when acted on by pressure urges the clamping ring away from the support surface and thus draws the spindle flange against the support surface of the sleeve.

7. A device according to claim 6, characterized by a plurality of piston-cylinder arrangements, which are distributed preferably uniformly over the circumference and which can be acted on pneumatically, between the support surface and the clamping ring.

8. A device according to claim 7, characterized in that the machine frame is cast from a polymer concrete, wherein the sleeve is cast in place in the machine frame with shape locking.

9. A device according to claim 8, characterized in that the adjusting mechanism comprises a setting shaft, which extends substantially in the third direction and is mounted on the machine frame to be axially fixed, but rotatable, and which carries at one end a fine thread which engages with a threaded nut or bush, which is fixedly mounted on the workpiece spindle, to be effective in actuation, a handle for manual rotation of the setting shaft being provided at the other end of the setting shaft.

10. A device according to claim 1, characterized in that the adjusting mechanism comprises a setting shaft, which extends substantially in the third direction and is mounted on the machine frame to be axially fixed, but rotatable, and which carries at one end a fine thread which engages with a threaded nut or bush, which is fixedly mounted on the workpiece spindle, to be effective in actuation, a handle for manual rotation of the setting shaft being provided at the other end of the setting shaft.

11. A device according to claim 10, characterized in that the setting shaft is supported merely at one end on the machine frame near the handle.

12. A device according to claim 9, characterized in that the threaded nut or bush is mounted on the workpiece spindle close to the spindle flange as seen in the second direction.

13. A device according to claim 9, characterized in that the handle is formed by a hexagon socket screw mounted on the setting shaft.

14. A device according to claim 2, characterized in that the sleeve has a lower, annular support surface, which is axially opposite a clamping ring fastened to the workpiece spindle, wherein the clamping mechanism comprises at least one, optionally annular, piston-cylinder arrangement, which is arranged between the support surface and the clamping ring to be effective in actuation and which when acted on by pressure urges the clamping ring away from the support surface and thus draws the spindle flange against the support surface of the sleeve.

15. A device according to claim 14, characterized by a plurality of piston-cylinder arrangements, which are distributed preferably uniformly over the circumference and which can be acted on pneumatically, between the support surface and the clamping ring.

16. A device according to claim 2, characterized in that the machine frame is cast from a polymer concrete, wherein the sleeve is cast in place in the machine frame with shape locking.

17. A device according to claim 16, characterized in that the adjusting mechanism comprises a setting shaft, which extends substantially in the third direction and is mounted on the machine frame to be axially fixed, but rotatable, and which carries at one end a fine thread which engages with a threaded nut or bush, which is fixedly mounted on the workpiece spindle, to be effective in actuation, a handle for manual rotation of the setting shaft being provided at the other end of the setting shaft.

18. A device according to claim 1, characterized by a distance sensor, which is fastened to the machine frame, for detecting a displacement of the workpiece spindle relative to the machine frame in the third direction.

19. A device according to claim 18, characterized in that the distance sensor is a tactile measuring probe engaging the workpiece spindle.

* * * * *